United States Patent [19]

Alexander, Sr.

[11] 4,221,240

[45] Sep. 9, 1980

[54] APPARATUS AND METHOD FOR ABSORBING MOISTURE REMOVED FROM FLUID-JET LOOM

[75] Inventor: Jack L. Alexander, Sr., Greensboro, N.C.

[73] Assignee: Air Conditioning Corporation, Greensboro, N.C.

[21] Appl. No.: 946,880

[22] Filed: Sep. 29, 1978

[51] Int. Cl.[2] ..... D03J 1/06

[52] U.S. Cl. ..... 139/1 R; 34/72; 139/291 R; 139/435

[58] Field of Search ..... 139/1 R, 291 R; 19/66 R; 68/5 C; 34/72, 73, 75; 62/93, 94

[56] References Cited

U.S. PATENT DOCUMENTS

| | | | |
|---|---|---|---|
| 3,703,814 | 11/1972 | Davis | 62/93 |
| 3,857,418 | 12/1974 | Kida et al. | 139/291 R |
| 3,899,023 | 8/1975 | Zander et al. | 62/93 |
| 3,961,651 | 6/1976 | Balentine | 139/291 R |

*Primary Examiner*—Henry Jaudon

*Attorney, Agent, or Firm*—Lane, Aitken, Ziems, Kice & Kananen

[57] ABSTRACT

An apparatus and method for absorbing a portion of the moisture removed from material woven on a fluid-jet loom. A shed of warp yarns is formed in the loom and a fluid jet is used to feed weft yarns into the warp yarns for forming a length of woven material. An opening extends at least the width of the length of material, and the material is moved over the opening. Air is pulled through the opening for removing moisture from the length of material as it moves over the opening. The air has a temperature greater than that of the surrounding atmosphere. The improvement includes reducing the temperature of the moisture-laden air to at least the dew point of the surrounding atmosphere for reducing the moisture content of the air before the air enters said surrounding atmosphere.

9 Claims, 4 Drawing Figures

APPARATUS AND METHOD FOR ABSORBING MOISTURE REMOVED FROM FLUID-JET LOOM

Background of the Invention

This invention relates to liquid-jet shuttleless looms and, more particularly, to an apparatus and method for absorbing a portion of the moisture which is removed from material woven on such a loom.

Fluid-jet looms are used to weave material, and instead of shuttles they use a jet of liquid to feed weft yarns into a shed of warp yarns in predetermined cycles. The length of woven material formed by this type of operation is advanced over a stripper blower, which includes a narrow slot over which the material passes, in order to reduce the amount of liquid in the woven material prior to rolling the material onto a take-up roll. Moisture is removed from the material by pulling a vacuum through the slot which extends the width of the length of material.

The moisture-laden air is then normally discharged into the surrounding atmosphere which is the room in which the fluid-jet loom is located. This moisture-laden air, which was initially taken from the room, pulled through the woven cloth, stripper slot and accompanying conduits, is normally discharged back into the room at a significantly higher temperature and also includes a significantly greater amount of moisture.

In order to maintain the room at a tolerable temperature and humidity, the amount of moisture in the air has to be reduced and the air temperature lowered by means of an air-conditioning system. The discharging of wetter, hotter air into the room accordingly results in a heavier load on the air-conditioning system which significantly increases the air-conditioning costs as well as the amount of energy which must be used to run the air-conditioning system.

Summary of the Invention

In accordance with the invention, the problems mentioned above have been alleviated by means of the subject invention. The apparatus and method operate to reduce the temperature of the moisture-laden air, and accordingly its moisture content, approximately to the dew point of the room so that the moisture in the air will not be given up to the room.

The air temperature can be reduced by passing the air through a chamber in which cold water is sprayed to lower the temperature of the air. This will quench the air and lower the temperature to an appropriate level. The same effect can be achieved by passing the moisture-laden air through a coil in which a chilled fluid is circulated, which is located at the discharge end of the stripper blower. Another alternative for accomplishing the same results is to pass the moisture-laden air through a moisture trap located at the discharge end of the stripper blower and then through the coil of the room air-conditioning system before discharging the air into the room.

In this way, the moisture is removed by means other than the room air-conditioning system which effectively reduces the energy required for maintaining the surrounding atmosphere at a tolerable operating temperature and significantly reduces the air conditioning costs.

Therefore, it is an object of the invention to reduce the moisture content and lower the temperature of air discharged into the operating room of a fluid-jet loom after the air has been used to remove excess moisture from cloth woven on the loom.

It is a further object of the invention to reduce the temperature of air in which the excess moisture is laden, approximately to the dew point of the surrounding atmosphere, so that when the moisture-laden air is discharged into the atmosphere no moisture will be given up to the room.

It is a further object of the invention to reduce the amount of energy used and the expense of operating the water-jet loom by reducing the load on an air-conditioning system which is used to maintain the temperature in the surrounding atmosphere at a predetermined level.

Brief Description of the Drawings

Other objects and advantages of the invention will become apparent from the following detailed description of preferred embodiments when taken in conjunction with the accompanying drawings in which.

Detailed Description of Preferred Embodiments

Figure 1:
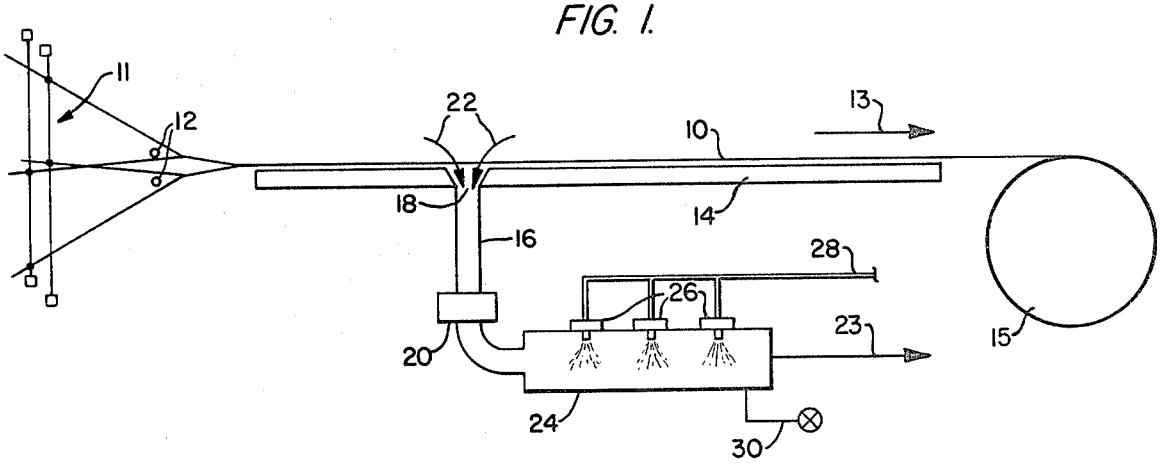
FIG. 1 is a schematic drawing of one embodiment of the invention where moisture-laden air is passed through a chamber and sprayed with cold water.

Referring now to FIG. 1, one embodiment of the invention will be described in detail where reference numeral 10 is used to identify a length of material woven on a fluid-jet loom. The fluid-jet loom is of a known type which includes means for forming a shed of warp yarns 11 and fluid jet means 12 for feeding weft yarns into the warp yarns for forming a length of woven material. The length of material is moving in the direction of an arrow 13 over a support plate 14 toward a take-up roll 15, a chamber 16 being connected to the bottom side of the plate 14 and communicating with the other side of the plate 14 through a slot 18. A vacuum pump 20 is located downstream from the slot 18 for pulling air through the slot 18 as indicated by arrows 22 for removing excess moisture from the length of material 10 as it passes over the slot 18. The air is discharged to the surrounding atmosphere from the pump 20 as indicated by an arrow 23. These elements are generally referred to as a "stripper blower."

In accordance with the invention, the temperature of the moisture-laden air which is pulled through the slot 18 is reduced approximately to the dew point of the surrounding atmosphere or room before the air is discharged back into the room so that moisture contained in the air will not be given up to the room. As shown in FIG. 1, this is accomplished by a spray chamber 24 which is connected at the discharge of the vacuum pump 20, a plurality of nozzles 26 being provided to spray cold water into the chamber 24 which is supplied through a supply pipe 28. Water spray through the nozzles 26, along with moisture removed from air passing through the chamber 24, can be removed from the chamber 24 through the outlet pipe 30.

In operaton, for example, the stripper blower can pull room air through the slot 18 at approximately 79° F., dry bulb temperature, and 60% relative humidity. As it is moving, the air is heated to about 81° F. and pulls enough moisture from the moving length of material 10 to raise its relative humidity to about 92% . This device can effectively reduce the moisture level in a loom at about 1.4 lbs. of moisture per hour. It has been found that the quenching device as shown in FIG. 1 can reduce the amount of moisture liberated from the water-jet loom in the moisture-laden air by approximately 25% . Other levels of moisture removel can be achieved by adjusting the temperature of the water sprayed through the nozzles 26, the temperature level being ascertainable by one with ordinary skill in the art.

Figure 2:
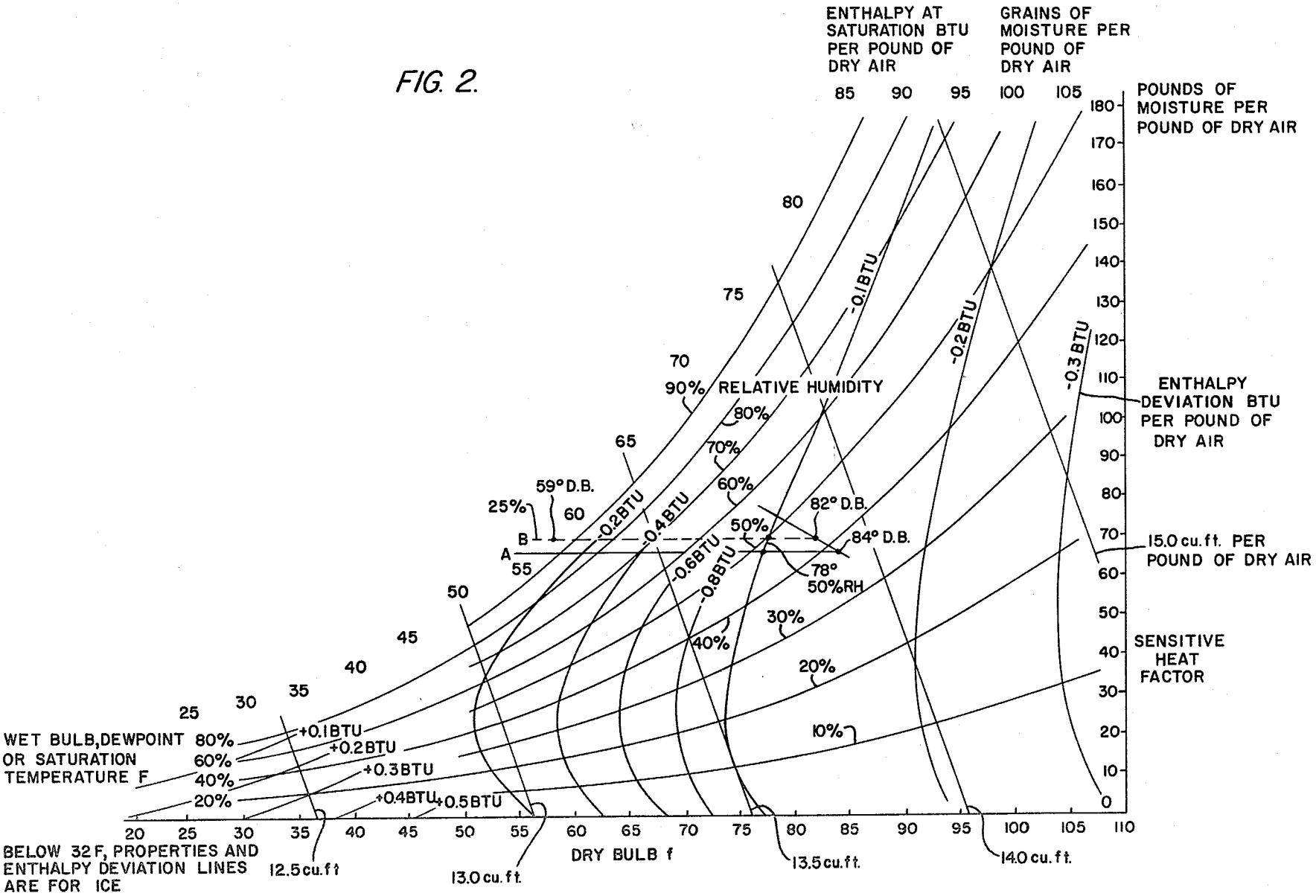
FIG. 2 is a standard psychrometric chart used to illustrate the efficiency of the invention.

In a normal operation, for example, where the invention is not used and the moisture-laden air is discharged directly to the room, in order to maintain the room at a temperature of 78° F., a 26 ° F. air rise is required. In other words, air supplied to the room at about 58° F. dry bulb would rise to about 84° F. dry bulb. The moisture liberated by the loom would then cool the room adiabatically to about 78° F. at about 55% relative humidity. This is shown on the standard psychrometric chart of FIG. 2 by the dotted line designated "A".

The solid line "B" represents the same system which is operating in accordance with the invention where the total amount of moisture given up by the loom has been reduced approximately 25% . As can be seen, air can be supplied to the room at about 59° F. dry bulb and the room would rise to about 82° F. dry bulb. The moisture liberated by the loom would then cool the room adiabatically to about 78° F. at about 55% relative humidity. This represents a total saving in air quantity supplied to the same room of approximately 12% which is 1 −(82° F.−59° F.)/84° F.−58° F.

Figure 3:
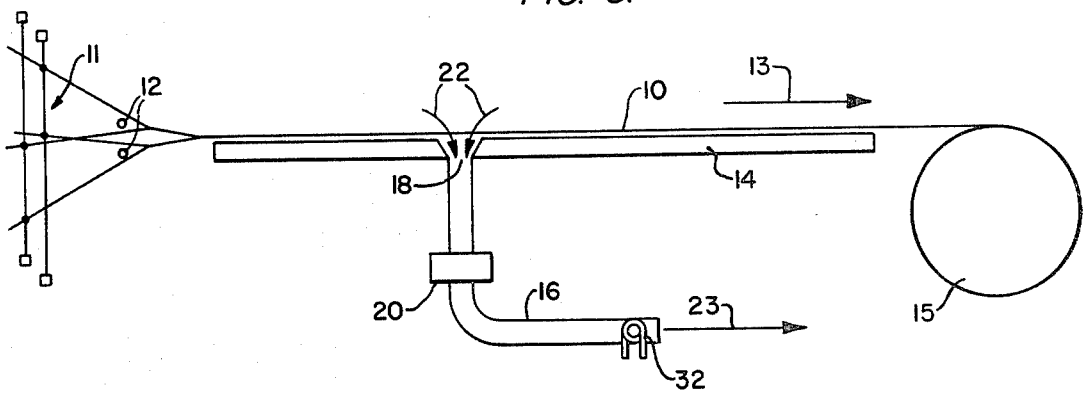
FIg. 3 is a schematic view of a second alternative embodiment of the invention where a coil is used to lower the temperature of the moisture-laden air.

Another way of achieving the same results is shown in FIG. 3 where a coil 32 through which chilled water is circulated is located at the discharge end of the chamber 16 so that the air can be circulated through the coil 32 to reduce the dry bulb temperature of the air and therefore remove some of the moisture before the air is liberated to the room.

Figure 4:
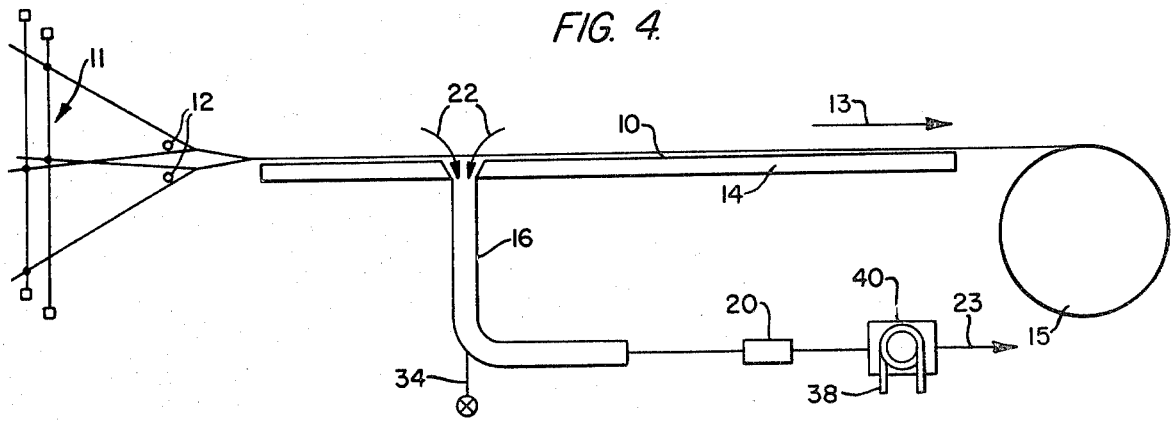
FIG. 4 is a schematic view of a third embodiment of the invention where a water trap is used to remove some moisture from the air which is then passed through the coil of the room air-conditioning system before being discharged into the surrounding atmosphere.

A third embodiment is shown in FIG. 4 where a moisture trap 34 is provided on the discharge end of the chamber 16, the trap being of any known type such as a collector pipe. After passing through the moisture trap, the air is circulated through a coil 38 of a room air-conditioning system designated by reference numeral 40 before being discharged into the surrounding atmosphere.

In this way, a portion of the moisture removed from material woven on a fluid-jet loom can be absorbed prior to the time moisture-laden air is discharged into the surrounding atmosphere by reducing the temperature of the moisture-laden air at least to the dew point of the surrounding atmosphere. In this way, the load on the air-conditoning system for the surrounding atmosphere is significantly reduced which saves operating expenses for the fluid-jet loom as well as being energy efficient.

It should be understood that the invention as defined in the appended claims will be able to have modifications and improvements made to it by one with ordinary skill in the art, and that all such modifications and improvements are contemplated as falling within the scope of the claims.

I claim:

1. Apparatus for absorbing a portion of the moisture removed from material woven on a fluid-jet loom of the type which comprises means for forming a shed of warp yarns, fluid jet means for feeding weft yarns into the warp yarns for forming a length of woven material, an opening extending at least the width of said length of material, means for moving said material over the opening, means for pulling air through the opening for removing moisture from the length of material as it moves over the opening, said air having a temperature greater than that of the surrounding atmosphere, the improvement comprising means for reducing the temperature of said moisture-laden air to at least the dew point of the surrounding atmosphere for reducing the moisture content of said air before said air enters said surrounding atmosphere.

2. The improvement of claim 1, wherein the opening includes a narrow slot.

3. The improvement of claim 1, wherein said temperature reducing means includes a chamber through which the air is passed, means for spraying within the chamber water at a temperature lower than the air temperature, and means for removing from said chamber said sprayed water and moisture removed from the air.

4. The improvement of claim 1, wherein said temperature reducing means includes a coiled pipe located in the path of said air downstream from the opening, means for circulating fluid through said pipe at a temperature lower than the air temperature.

5. The improvement of claim 1, wherein air conditioning means is provided to maintain said surrounding atmosphere at a predetermined temperature, said temperature reducing means including means for circulating said moisture-laden air through the coils of said air conditioning means before it enters the surrounding atmosphere.

6. A method for absorbing a portion of the moisture removed from material woven on a fluid-jet loom of the type which comprises means for forming a shed of warp yarns, fluid jet means for feeding weft yarns into the warp yarns for forming a length of woven material, an opening extending at least the width of said length of material, means for moving said material over the opening, means for pulling air through the opening for removing moisture from the length of material as it moves over the opening, said air having a temperature greater than that of the surrounding atmosphere, comprising the step of reducing the temperature of said moisture-laden air to at least the dew point of the surrounding atmosphere for reducing the moisture content of said air before said air enters the surrounding atmosphere.

7. The method of claim 6, wherein said step includes passing said air through a chamber, spraying said air while in the chamber with water at a temperature lower than the air temperature and removing from the chamber said sprayed water and the moisture removed from the air.

8. The method of claim 6, wherein said step includes passing said air through a coiled pipe before discharging the air to the surrounding atmosphere, circulating fluid through the coiled pipe at a temperature lower than the air temperature.

9. The method of claim 6, wherein said step includes maintaining said surrounding atmosphere at a predetermined temperature by using air conditioning means, and circulatiang said moisture-laden air through the coil of said air conditioning means before it enters the surrounding atmosphere.

* * * * *

UNITED STATES PATENT AND TRADEMARK OFFICE

CERTIFICATE OF CORRECTION

PATENT NO. : 4,221,240

DATED : September 9, 1980

INVENTOR(S) :

It is certified that error appears in the above—identified patent and that said Letters Patent is hereby corrected as shown below:

Column 4, lines 2-6 (claim 1, lines 1-5 of the claim), should read:

-- In combination with a fluid jet loom having means forming a shed of warp yarns, fluid jet means inserting weft yarns into successive warp sheds for forming a length of woven material, apparatus for removing moisture from said woven material and absorbing a portion of that moisture; said apparatus comprising an --.

Column 4, line 65, "circulatiang" should read -- circulating --.

Signed and Sealed this

*Sixth* Day of *January 1981*

[SEAL]

*Attest:*

SIDNEY A. DIAMOND

*Attesting Officer*

*Commissioner of Patents and Trademarks*